United States Patent [19]

Adachi et al.

[11] Patent Number: 5,039,476

[45] Date of Patent: Aug. 13, 1991

[54] METHOD FOR PRODUCTION OF POWDER METALLURGY ALLOY

[75] Inventors: Mitsuru Adachi; Akio Okamoto; Hideki Iwai; Yoshiharu Waku, all of Yamaguchi, Japan

[73] Assignee: Ube Industries, Ltd., Ube, Japan

[21] Appl. No.: 554,531

[22] Filed: Jul. 19, 1990

[30] Foreign Application Priority Data

Jul. 28, 1989 [JP] Japan ..... 1-193918
Sep. 19, 1989 [JP] Japan ..... 1-240801

[51] Int. Cl.[5] ..... B22F 32/00

[52] U.S. Cl. ..... 419/13; 419/11; 419/15; 419/17; 419/19; 419/32; 419/33; 419/41; 419/43; 419/57; 419/60; 75/235; 75/238; 75/249; 241/5

[58] Field of Search ..... 419/33, 32, 60, 57, 419/15, 11, 17, 13, 19, 41, 43; 241/5; 75/249, 235, 238

[56] References Cited

U.S. PATENT DOCUMENTS 4,347,076 8/1982 Ray et al. ..... 75/0.5 R
4,464,205 8/1984 Kumar et al. ..... 148/11.5
4,464,206 8/1984 Kumar et al. ..... 148/11.5
4,624,705 11/1986 Jatkar et al. ..... 75/239
4,830,820 5/1989 Itoh et al. ..... 419/23
4,941,920 6/1990 Inui et al. ..... 75/246

FOREIGN PATENT DOCUMENTS 64-75605 9/1987 Japan .
2-88704 1/1989 Japan .
1-298122 1/1989 Japan .
61-52328 6/1989 Japan .
1-143799 6/1989 Japan .
1-156402 6/1989 Japan .
1-180908 7/1989 Japan .

*Primary Examiner*—Stephen J. Lechert, Jr.
*Assistant Examiner*—Nina Bhat
*Attorney, Agent, or Firm*—Kanesaka and Takeuchi

[57] ABSTRACT

A method for the production of a metallic powder molding material is disclosed which comprises a step of imparting mechanical energy due to at least one of such physical actions as vibration, pulverization, attrition, rolling, shocks, agitation, and mixing a metallic particles in a vessel whose interior is held under vacuumized atmosphere or an atmosphere of inert gas thereby enabling the metallic particles to contact each other and acquire improvement in surface quality and a step of hot molding the metallic particles thereby producing a molding material.

13 Claims, 5 Drawing Sheets

METHOD FOR PRODUCTION OF POWDER METALLURGY ALLOY

FIELD OF THE INVENTION AND RELATED ART STATEMENT

This invention relates to a method for production of powder metallurgy (P/M) alloy. More particularly, this invention relates to a method for producing a metallic article by pretreating a metallic powder and then hot working the pretreated metallic powder.

In recent years, active studies have been under way in search of methods for producing component parts of automobiles, air vehicles, etc. with smaller weights, higher qualities, and greater load capacities. The conventional method which relies on combination of alloy composition, heat treatment, and processing hardly permits improvement in such characteristics as resistance to heat, wear resistance, strength, and stress corrosion resistance. Earnest studies, therefore, are being continued on feasibility of P/M alloys using rapidly solidified powder.

Unfortunately, rapidly solidified powder particles are liable to have oxides, physically adsorbed water, and water of crystallization on their surfaces. These extraneous substances, during the course of hot working of these particles, obstruct the adjacent particles from being compressed into fast cohesion. The hot worked material of these powder particles, therefore, are not fully satisfactory in such mechanical properties as fracture toughness and tenacity in the direction perpendicular to the direction of hot working. The rapidly solidified particles, therefore, must be deprived of such adhering extraneous substances prior to hot working.

In the case of a rapid solidified aluminum alloy particle, for example, a hydrated oxide layer 21 such as of $Al_2O_3.3H_2O$ and an oxide layer 22 such as of $Al_2O_3$ are generally formed on the surface of an aluminum alloy particle 20 as illustrated typically in FIG. 6 and, what is more, adsorbed water is liable to adhere thereto. Prior to hot working, therefore, the rapid solidified aluminum alloy particles are subjected to a hot vacuum degassing treatment generally resorting to the following procedure for the purpose of removal of moisture and water of crystallization. A mass of rapid solidified aluminum alloy powder particles is cold compacted. The cold compacted powder is sealed in a metallic can such as of aluminum and subjected to a degassing treatment at an elevated temperature (in the range of 350 to 500° C., for example) under a vacuum in the range of $10^{-2}$ to $10^{-5}$ Torr, with the can hermetically sealed thereafter. Further, for the purpose of disintegrating the oxides on the surface and facilitating fast cohesion of the adjacent particles, the processing is carried out at a relatively high extrusion rate.

The conventional method for producing a hot worked material using such rapid solidified particles as described above entails the following problems.

(1) The rapid solidified particles are deprived of their inherent nature because they are excessively annealed and softened during the course of degassing at an elevated temperature. Since the degassifying temperature consequently is not allowed to be elevated sufficiently, the hydrogen gas content in the hot worked material increases.

(2) Since the oxides on the surface are not sufficiently disintegrated by the hot working which may be carried out at a high extrusion rate as occasion demands, there is the possibility that the adjacent particles will fail to cohere with sufficient fastness in the interface. The hot worked material made of metallic particles, therefore, exhibits inferior fracture toughness. Further, the hot worked material acquires anisotropy in the mechanical properties (poorer mechanical properties in the direction perpendicular to the direction of extrusion than in the direction of extrusion).

OBJECT AND SUMMARY OF THE INVENTION

An object of this invention is to provide a method for the production of P/M alloy which easily permits a decrease in the hydrogen gas content, prevents occurrence of blisters, therefore obviates the necessity for undergoing degassing at an elevated temperature for an extended period, and avoids being excessively annealed.

Another object of this invention is to provide a method for the production of P/M alloy such that because of disintegration of oxide layers on the surface, the metallic particles expose their active surface and cohere effectively during the course of hot working and, as the result, hot worked material enjoys enhancement in fracture toughness and brings about an effect of curbing the anisotropy.

The present invention comprises a step of imparting mechanical energy by at least one of such physical actions as vibration, pulverization, attrition, rolling, shocks, agitation, and mixing to metallic particles in a vessel whose interior is held under a vacuumized atmosphere or in an atmosphere of inert gas thereby enabling the metallic particles to contact each other and acquire improvement in surface quality and a step of hot working the metallic particles.

Since the method of this invention improves the surface layers of metallic particles, this invention provides the following advantages.

(1) Hot worked materials easily permit a decrease of the hydrogen gas content and prevent occurrence of blisters and, therefore, the metallic particles need not be degassed at an elevated temperature for an extended period, which avoids excessive annealing. As the result, the microstructure obtained in consequence of rapid solidifying is curbed from the phenomenon of coarsening and is improved in fracture toughness.

(2) Since the metallic particles have their active surfaces in consequence of disintegration of oxide layers on the surface, cohesion of these metallic particles proceeds effectively during the course of hot working. As the result, the hot worked material enjoys improved fracture toughness and sparingly exhibits anisotropy in mechanical properties.

(3) In the case of rapidly solidified alloy particles which contain Mg in an amount of 0.1 to 15 wt. %, the aluminum oxide layer on the surface is effectively removed owing to the coexistence of magnesium oxide.

Incidentally, the pretreatment in the method of this invention aims exclusively to ensure fracture or separation of the surface layer of particle due to mutual contact of particles and, therefore, differs in nature from attrition by the use of a quality improving medium (such as, for example, metallic or ceramic balls), agitation by the use of a ball mill, or mechanical alloying. The surface quality of particles can be improved to some extent by the use of an ion mill or a ball mill. The use of such a quality-improving medium, however, has the possibility that owing to the impact arising from the collision of the medium against the surface of particles, water of crystallization and other forms of moisture, oxides, and hydroxides on the surface of particles, minute fragments separating from the quality-improving medium, and moisture and impurities adhering to the vessel will be incorporated in alloy particles. In contrast, since the present invention effects the disintegration or separation of the surface layer by virtue of mutual contact of particles, it has no possibility of entailing the incorporation of hydroxides and adsorbed water in the alloy particles.

When impartation of mechanical energy is carried out in combination with a preheating treatment or a heat treatment, elimination of adsorbed water on the powder surface or on the vessel and improvement of the surface quality of particles can be accelerated.

The oxides and other substances liable to form on the surface of metallic particles generally have a thickness in the range of 100 to 200 Å. The impartation of mechanical energy decreases this thickness virtually to 0 Å. Degassing of metallic powder particle evacuates practically completely $H_2O$ and $H_2$ by evaporating physically adsorbed $H_2O$ and decomposing hydroxides from the surface oxide.

When the metallic particles are extruded immediately after the treatment for impartation of mechanical energy, no new oxide is allowed to occur on the metallic particles. When the metallic particles which have undergone the treatment for impartation of mechanical energy are left standing in the open air for a period of 30 minutes to 1 hour, the oxide layer formed on the particle surface is found to have only a very small thickness approximately in the range of 10 to 20 Å. When the metallic particles are subjected to working only briefly after the treatment of impartation of mechanical energy, satisfactory results are obtained in spite of their exposure to the ambient air in the meantime. When the metallic particles retain their dry state during the course of working, hot working material has no water content.

DESCRIPTION OF THE PREFERRED EMBODIMENTS

Figure 1:
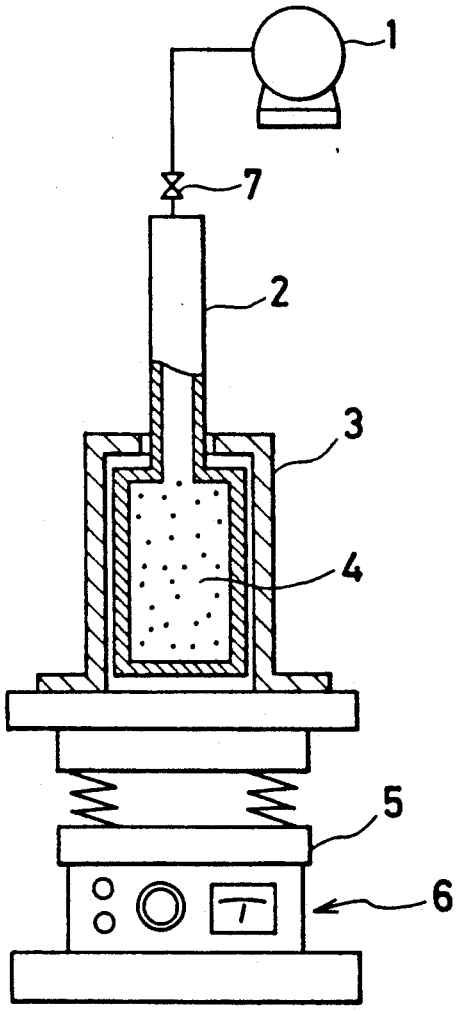
FIGS. 1 to 5 are longitudinal cross sections each illustrating different devices used in the present invention.

The metallic powders to which the method of the present invention is affectively applicable are particles of metals or alloys of Al, Mg, Ti, Fe, Ni, W, and Mo which are mainly obtained by rapidly solidified. Though cooling rate of solidification of a given metal powder is variable with the kind of metal or alloy under treatment, it is desired to be in the range of 50 to $10^{6}$° C./sec. In the case of an aluminum alloy, for example, if the cooling rate is less than 50° C./sec., the intermetallic compounds of Si and Al-Fe which are contained in the aluminum alloy are crystallized out in coarse grains to the extent of impairing the mechanical properties of the produced material. Thus, the cooling rate must exceed 50° C./sec. Conversely, if the cooling rate is excessively high, &he effect of rapid solidification (RS) is not proportionately improved but the difficulty of RS technique is proportionately aggravated and the cost is consequently boosted. The cooling rate, therefore, is desired to be in the range of 50 to 106° C./sec.

The metallic powder obtained as described above is a finely divided powder which may assume a varying shape such as sphere, flake, or thread, depending on the conditions of production.

The powder alloys which are desirable for this invention are such aluminum alloys as alloys of the Al-Si system, Al-Si-Cu system, Al-Zn system, and Al-Fe system, for example. These alloys may contain Mg and may further incorporate therein such transition metals as Ni, W, Mo and Fe. Powder alloys containing Mg and having an oxide layer which comprises Mg are specifically desirable. The contents of such other metal components which are contained in the aluminum alloys are generally in the following ranges.

Si: 10 to 30% by weight
Mg: 0.1 to 20% by weight
Cu: 0.5 to 8.0% by weight
Fe: 0.5 to 10.0% by weight
Zn: 0.01 to 10.0% by weight Of course, the present invention can be applied to the pretreatment of various metals and alloys including various aluminum alloys other than those mentioned above.

When the mechanical energy to be imparted to the metallic particles is in the form of vibration, this impartation is accomplished by packing a container with rapid solidified metallic particles, placing the filled container on a vibration device, and shaking the container with the vibration device for a period in the range of 1 to 2 hours, with the interior of the container not exposed to the ambient air but held in a vacuumized atmosphere of an atmosphere of inert gas. When this mechanical energy is in the form of mixing, the impartation of the mechanical energy is accomplished by packing a cylindrical container or a V shaped container with the metallic particles and mixing the metallic particles, with the interior of the container not exposed to the ambient air but held in a vacuumized atmosphere or an atmosphere of inert gas. When the mechanical energy is in the form of shocks, the impartation of this mechanical energy is attained by causing the metallic particles to collide against baffle plates with a high-speed jet of inert gas inside a container the interior of which is held in an atmosphere of inert gas. When the mechanical energy is in the form of agitation, the impartation of this mechanical energy is accomplished by packing a container with the metallic particles and operating rotary vanes inside the container, with the interior of the container held in a vacuumized atmosphere or in an atmosphere of inert gas.

The hot working contemplated by the present invention is attained by extrusion or by forging, HIP, hot pressing, or rolling, for example.

Now, the present invention will be described further in detail below with reference to accompanying drawings.

Figure 2:
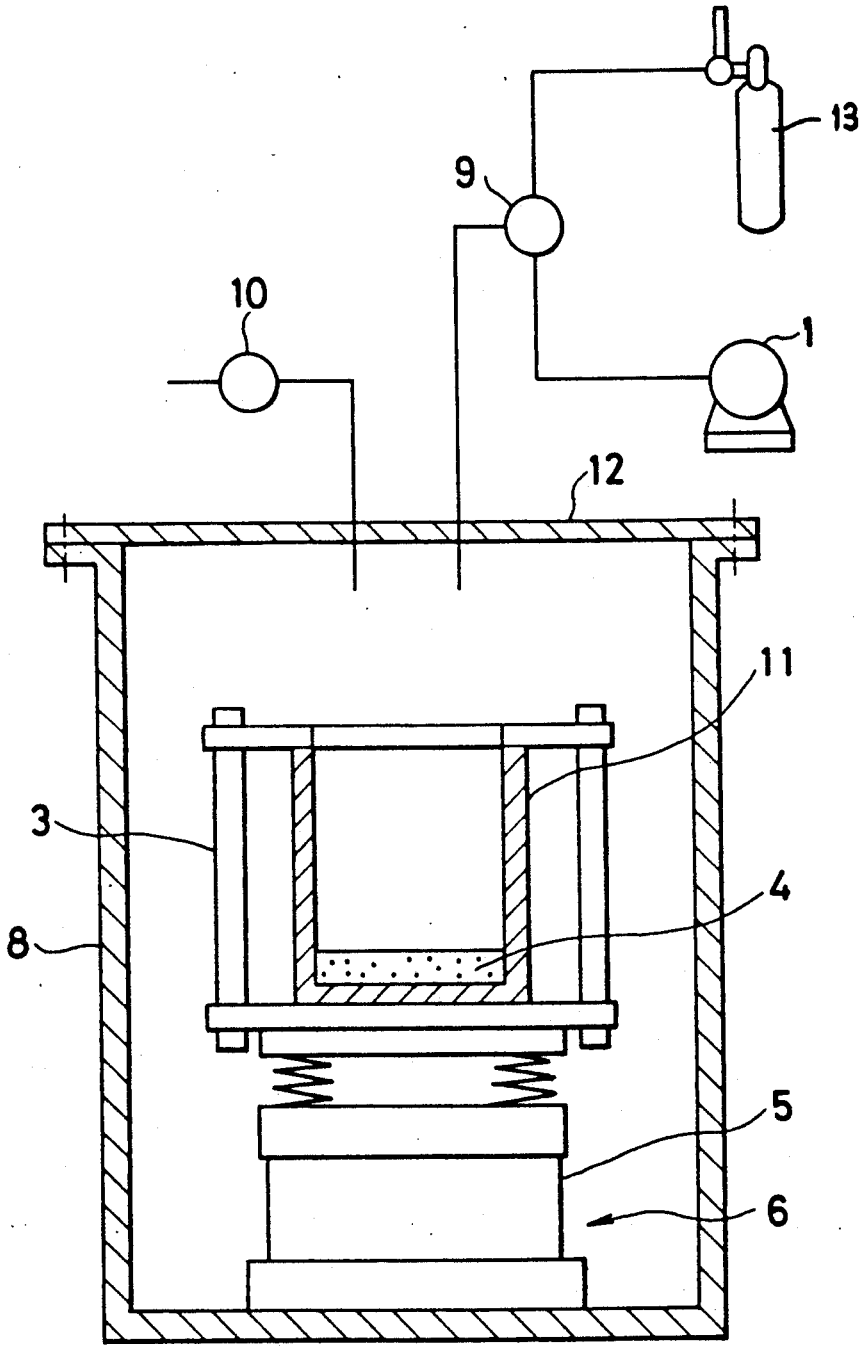

FIG. 1 and FIG. 2 illustrate vibration devices for preferred embodiments of the present invention. FIG. 1 is a partial longitudinal cross section of a vibration device which vibrates metallic particles and improves their quality within a hermetically sealed container capable of keeping its contents completely out of contact with the ambient air until the vacuum degassing is completed. FIG. 2 is a partial longitudinal cross section of a vibration device in which the metallic particles are exposed to the ambient air when they are transferred into a separate container used exclusively for degassing.

Figure 3:
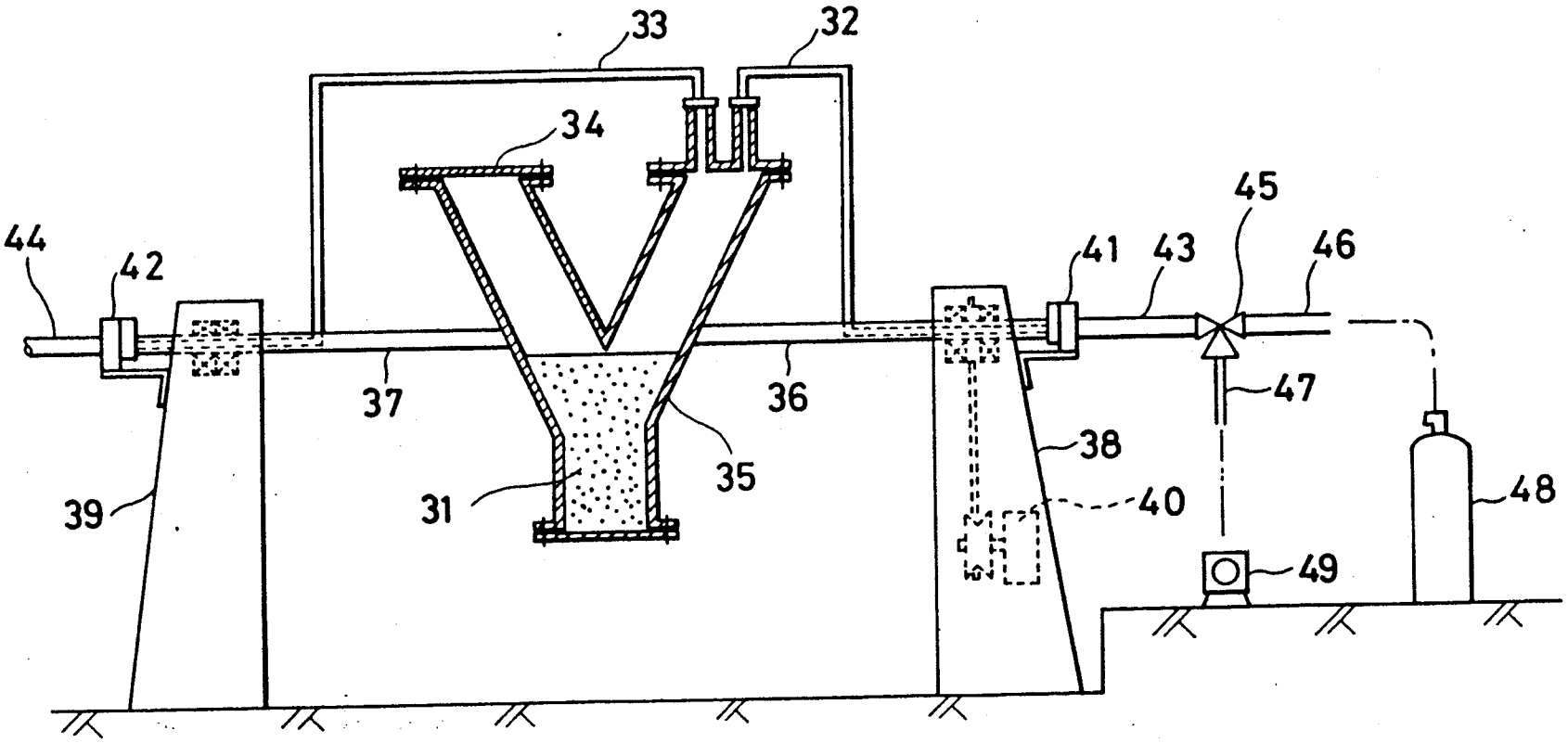
Figure 4:
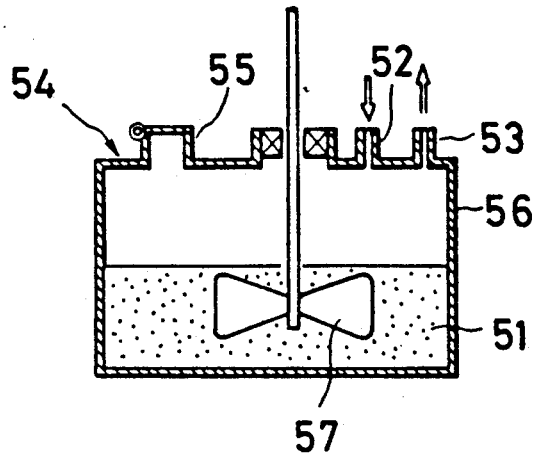
Figure 5:
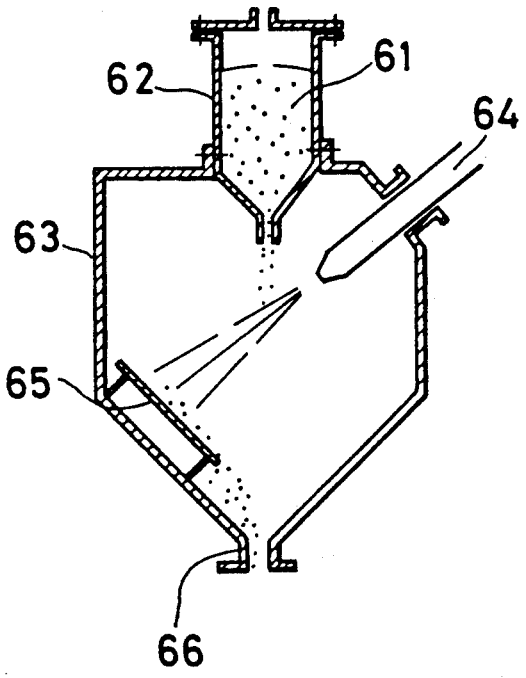
Figure 6:
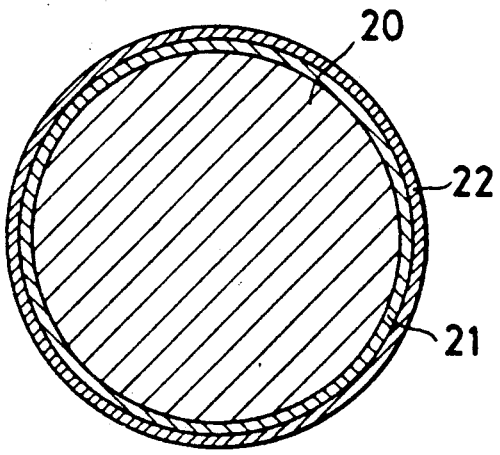
FIG. 6 is a typical cross section illustrating an aluminum alloy particle.

FIG. 3 and FIG. 4 illustrate mixing and stirring devices suitable for embodiments of this invention. FIG. 5 illustrates a device which operates by virtue of shocks, i.e. a partial longitudinal cross section of a device for giving metallic particles a treatment for quality improvement in an atmosphere of inert gas or in a vacuumized atmosphere. In any of the devices mentioned above, the metallic particles are destined to expose themselves to the ambient air while they are being transferred into a separate container used exclusively for degassing.

With reference to FIG. 1, a hermetically sealed aluminum container 2 filled with metallic particles 4 is placed and immobilized on a vibration device 6 provided with a vibration motor 5. The hermetically sealed aluminum container 2 is provided on the upper side thereof with a cock 7 and a pipe is laid to interconnect the cock 7 and a vacuum pump 1. An inert gas inlet pipe (not shown) is connected to the hermetically sealed aluminum container 2.

In an apparatus constructed as described above, the metallic particles 4 placed in the hermetically sealed aluminum container 2 by opening the cock 7 under a vacuumized atmosphere or an atmosphere of inert gas are exposed for a period in the range of 0.2 to 20 hours, desirably 0.5 to 5 hours, and particularly desirably 1 to 2 hours to the vibration which is started by actuating the vibration device 6 and the vacuum pump 1.

With reference to FIG. 2, an upper opening type container 11 filled with metallic particles 4 is placed and immobilized on a vibration device 6 provided with a built-in vibration motor 5. The parts arranged as described above are wholly inserted in a hermetically sealed box 8 provided with a lid 12. Two pipes are connected to the lid 12 as inserted therethrough. One of these pipes is connected to a valve 10 and adapted to partly release the inert gas introduced into the hermetically sealed box 8 and allowing the box interior to resume the atmospheric pressure. The other pipe is connected to an inert gas source 13 through the medium of a three way valve g and Is adapted to connect the other pipe to the vacuum pump 1 while it is not introducing the inert gas.

In the apparatus constructed as described above, the vibration device 6 and the vacuum pump 1 are actuated, the three-way valve 9 is switched to create a vacuumized atmosphere or an atmosphere of inert gas inside the hermetically sealed container 8, and the metallic particles 4 placed in the upper opening type container 11 are consequently shaken.

In this case, in the apparatus of FIG. 1 and FIG. 2, the intensity of the vibration is properly selected to suit the kind and size of metallic particles under treatment. No fully satisfactory mechanical energy can be imparted when the frequency or the amplitude is unduly small.

In an apparatus illustrated in FIG. 3, metallic particles 31 of a prescribed amount are placed in a V-shaped container 35 which is provided with a lid 34 and two pipes 32, 33 fitted therein. The V-shaped container 35 is supported by bases 38, 39 through the medium of shafts 36, 37 and is adapted to be rotated with a motor 40 disposed inside the base 38. The pipe 32 is led through the shaft 36 and allowed to communicate with a rotary joint 41 and the pipe 33 is led through the shaft 37 and allowed to communicate with a rotary joint 42. Other pipes 43, 44 are connected respectively to the rotary joints 41, 42. The pipe 43 is connected to pipes 46, 47 through the medium of a three-way valve 45. The pipe 46 is connected to an inert gas source 48 and the other pipe 47 is connected to a vacuum pump 49. The pipes 33, 44 have the part of allowing resumption of atmospheric pressure.

In an apparatus illustrated in FIG. 4, metallic particles 51 of a prescribed amount are placed in a cylindrical container 56 which is provided with a lid 54 having two pipes 52, 53 and an insertion port 55 fitted thereto. The pipe 53 is extended through a three-way valve in two directions and connected to an inert gas source and a vacuum pump. The pipe 52 has a part of allowing resumption of atmospheric pressure. Rotary vanes 57 agitate and mix the metallic particles uniformly.

In the apparatus constructed as described above, mutual contact of metallic particles is generated in a vacuumized atmosphere or an atmosphere of inert gas by the rotation of the V-shaped container 35 in the apparatus of FIG. 3 or the rotation of rotary vanes 57 in the apparatus of FIG. 4.

In an apparatus illustrated in FIG. 5, metallic particles 61 are caused to fall in a prescribed rate from a container 62 into a container 63 held in an atmosphere of inert gas and a current of inert gas 64 is advanced downwardly at a high speed from the lateral part of the container 63 to cause collision of a baffle plate 65 and metallic particles. Thereafter, the metallic particles are taken out of a discharge outlet 66.

The metallic particles which have undergone the pretreatment according to the method of this invention are converted into a hot worked material by the technique of extrusion.

In accordance with the method using the apparatus of FIG. 1, the metallic particles are not exposed at all to the ambient air until completion of the vacuum degassing. In accordance with the methods using the apparatuses of FIG. 2, FIG. 3, FIG. 4, and FIG. 5, the metallic particles are exposed once to the ambient air while they are being transferred into the container for degassing. This transfer, therefore, must be carried out with minimum loss of time.

The treatment of degassing which is aimed at the removal of $H_2O$ from the particle surface is desired to be conducted at a high degree of vacuum of less than 100 torrs. Otherwise, it may be carried out in an atmosphere of inert gas such as argon or nitrogen gas or even in the open air.

The present invention embraces the production of a composite by causing the reinforcing fibers such as of SiC incorporated into the metallic particles during the step of the impartation of mechanical energy upon the metallic particles.

In the invention, fibrous of powder material for reinforcement may be added to the metallic particles to produce a composite material before they are given mechanical energy, or before they are hot worked. Such reinforcing material may be continuous fiber, short fiber, whisker or powder of such refractory as silicon carbide, silicon nitride, alumina, silica, alumina-silica, zirconia, beryllia boron carbide, titanium carbide, carbon, metal or intermetallic compound.

In the invention, the metallic particles may be vibrated in a vessel to become compact after they are imparted mechanical energy and before they are hot worked.

Now, the present invention will be described more specifically below with reference to working examples and comparative experiments.

EXAMPLES 1 TO 3 AND COMPARATIVE EXPERIMENTS 1 AND 2:

Aluminum alloy particles (Al, 17% Si, 4.5% Cu, 0.6% Mg, 6% Fe) having 149 to 44 μm in diameter rapidly solidified at a cooling rate in the range of $10^3$ to $10^4$° C./sec. by the nitrogen gas atomizing method were subjected to treatment for vacuum degassing under varying conditions indicated in Table 1. The premolded material consequently formed was subjected to be hot extruded at an extrusion ratio of 5.7, an extrusion speed of 2.8 mm/sec., and a temperature of 400° C.

The extruded material was tested for presence/absence of blister, hydrogen gas content, and impact strength. The results are shown in Table 1.

by the nitrogen gas atomizing method were extruded after they were undergone pretreatment under the condition indicated in the column of Examples 4 to 8 on Table 2 respectively and degassificated respectively. For comparison, the same metallic particles were extruded under the condition indicated in the column of Comparative Experiment 3 of Table 2 without undergoing the pretreatment. For further comparison, the same metallic particles were degassed and then extruded under the conditions indicated in the column of Comparative Experiment 4 of Table 2 without undergoing the pretreatment.

The hot worked materials consequently obtained were tested for hydrogen gas content, tensile strength, and impact strength. The results were as shown in Table 2.

It is clearly noted from Table 2 that the hot worked materials obtained by the method of this invention show

TABLE 1

| Comparative Example No | Conditions for vibration: Frequency (Hz) | Time (minute) | Method of vibration *1 | Condition for vacuum degassing: Temperature (°C.) | Time (minute) | Presence/absence of blister *2 | Hydrogen gas content (Cm/100 Al) *3 | Impact strength *4 |
|---|---|---|---|---|---|---|---|---|
| Example | | | | | | | | |
| 1 | 100 | 30 | A | 520 | 60 | ◎ | 1.2 | 1.3 |
| 2 | 100 | 60 | A | 520 | 30 | ○ | 1.7 | 1.2 |
| 3 | 100 | 30 | B | 520 | 60 | ◎ | 1.3 | 1.3 |
| Comparative Experiment | | | | | | | | |
| 1 | without pretreatment | | | 520 | 60 | Δ | 1.4 | 1.0 |
| 2 | without pretreatment | | | 520 | 30 | × | 3.7 | 0.9 |

*1 A: Hermetically sealed type (FIG. 1), vacuumized atmosphere.
B: Partially closed type (FIG.2), atmosphere of Ar gas.
*2 Presence/absence of blister - Results of observation of cross-section microstructure of extruded material undergone heat-treatment at 500° C. × 24 hr. rated on the four-point scale, wherein ◎ stands for complete absence of blister, ○ for virtual absence of blister, Δ for conspicuous presence of blisters, and × for presence of a very large number of blisters.
*3 The hydrogen gas content was determined by measuring the amount of hydrogen gas contained in a given sample of the extruded material by the melt extraction method.
*4 The magnitude of impact strength was determined by testing for charpy impact specimen from the extruded material in a form not yet heat-treated and calculating the found value of resistance based on the similarly found value of the sample of Comparative Experiment 1.

It is clearly noted from Table 1 that the hot worked material of metallic particles produced by the method of this invention contains absolutely no blister and exhibits high magnitude of shock resistance.

Figure 7A:
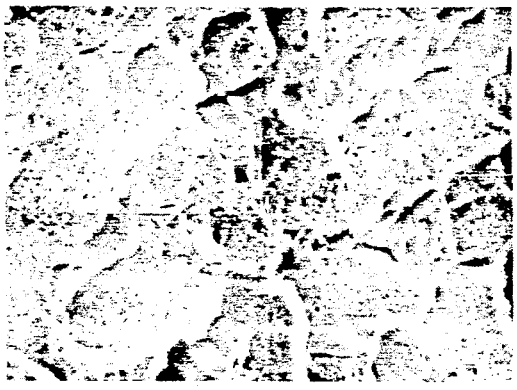
FIG. 7A and FIG. 7B are photomicrographs of a fractured surface of alloy.
Figure 7B:
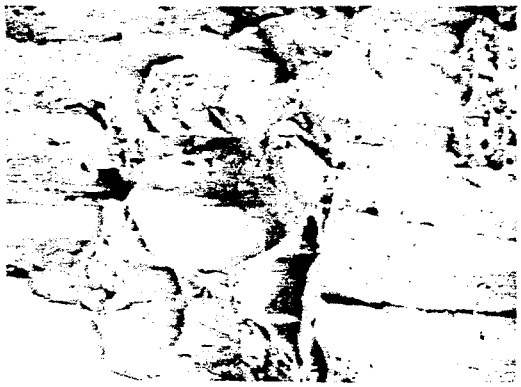

EXAMPLES 4 TO 8 AND COMPARATIVE EXPERIMENTS 3 AND 4:

Aluminum alloy particles (7091 alloy; Al, 6.7% Zn, 2.6% Mg, 1.7% Cu, and 0.4% Co) and magnesium alloy particles (AZ91 alloy; Mg, 8.5% Al, 2% Zn and 0.4% Mn) having 149 to 44 μm in diameter and rapidly solidified at a cooling rate in the range of $10^3$ to $10^4$° C./sec.

virtually no anisotropy of mechanical properties and exhibit high values of impact strength. When the fractured surfaces sustained by the samples of 7091 alloy during the test for impact strength were visually examined, the samples having the particle surface improved as illustrated in FIG. 7A by treatment with mechanical energy showed very small fracture from particle boundaries and discernible dimple fracture indicative of ductile fracture as compared with the samples having escaped the treatment for surface improvement as illustrated in FIG. 7B.

TABLE 2

| Comparative Example No | Conditions for pretreatment | | Apparatus for treatment | Alloy | Conditions for degassification: Temperature (°C.) | Time (minute) | Conditions for extrusion: Ratio | Temperature (°C./sec) | speed (mm/sec) | Hydrogen gas content (cc/100 g-Al) | *1 Relative impact strength | *2 Tensile strength in L direction | *2 Tensile strength in T direction |
|---|---|---|---|---|---|---|---|---|---|---|---|---|---|
| Example | | | | | | | | | | | | | |
| 4 | Frequency<br>Acceleration<br>Time<br>Atmosphere | 100 Hz<br>3 G<br>2 h<br>$10^{-2}$ torr *3 | Apparatus in FIG. 2 | 7091 | 520 | 60 | 10 | 420 | 3 | 0.3 | 2.2 | 62.5 | 62.0 |
| 5 | Revolution number<br>Time<br>Atmosphere | 70 rpm<br>2 h<br>nitrogen | Apparatus in FIG. 3 | 7091 | 520 | 60 | 10 | 420 | 3 | 0.4 | 1.7 | 62.8 | 57.8 |
| 6 | Revolution | 70 rpm | Appa- | AZ91 | — | — | 10 | 350 | 3 | 4.7 | 1.5 | 33.5 | 30.2 |

TABLE 2-continued

| Comparative Example No | Conditions for pretreatment | | Apparatus for treatment | Alloy | Conditions for degassification: Temperature (°C.) | Conditions for degassification: Time (minute) | Conditions for extrusion: Ratio | Conditions for extrusion: Temperature (°C./sec) | Conditions for extrusion: speed (mm/sec) | Hydrogen gas content (cc/100 g-Al) | *1 Relative impact strength | *2 Tensile strength in L direction | *2 Tensile strength in T direction |
|---|---|---|---|---|---|---|---|---|---|---|---|---|---|
| | number | | ratus in FIG. 4 | | | | | | | | | | |
| | Time | 1 h | | | | | | | | | | | |
| | Atmosphere | $10^{-3}$ torr | | | | | | | | | | | |
| 7 | Flow rate of gas | 2 m/s | Apparatus in FIG. 5 | 7091 | 520 | 60 | 10 | 420 | 3 | 0.4 | 1.5 | 63.1 | 58.1 |
| | Atmosphere | nitrogen gas | | | | | | | | | | | |
| 8 | Revolution number | 70 rpm | Apparatus in FIG. 4 | AZ91 | — | — | 10 | 350 | 3 | 4.2 | 1.5 | 34.0 | 32.3 |
| | Time | 1 h | | | | | | | | | | | |
| | Atmosphere | $10^{-3}$ torr | | | | | | | | | | | |
| | Temperature | 300° C. | | | | | | | | | | | |
| | Preheating *3 | 150° C. | | | | | | | | | | | |
| Comparative Experiment | | | | | | | | | | | | | |
| 3 | without pretreatment | | — | AZ91 | — | — | 10 | 350 | 3 | 4.3 | 1.0 | 33.2 | 22.7 |
| 4 | without pretreatment | | — | 7091 | 520 | 60 | 10 | 420 | 3 | 0.6 | 1.0 | 63.0 | 47.5 |

*1 Relative impact strength: This property was evaluated, with the magnitude of impact strength (absorbed energy/cross section after fracture) found of a sample undergone no pretreatment taken as 1.
*2 Tensile strength: The tensile strength in the direction perpendicular to the direction of extrusion was reported as that in T direction and the tensile strength in the direction of extrusion as that in L direction, respectively with the denomination of kg/mm$^2$.
*3 Preheating (150° C. × 30 minutes) prior to the treatment with vibration and heating (350° C. × 30 minutes) during the treatment with vibration.

EXAMPLES 9 AND 10 AND COMPARATIVE EXPERIMENTS 5 TO 7:

Aluminum alloy particles (Al, 8% Fe, 1.5% Zr, 1.5% Cr, and Mg content shown in Table 3) having 149 to 44 μm in diameter and rapidly solidified at a cooling rate in the range of $10^3$ to $10^4$° C./sec. by the nitrogen gas atomizing method were pretreated under the conditions indicated in Table 3 and subsequently subjected to treatment for vacuum degassing under a vacuum of $10^{-5}$ torr at 400° C. for 1 hour. The resultant premolded material was subjected to hot extrusion at an extrusion ratio of 7, an extrusion speed of 2.8 mm/sec, and a temperature of 440° C. The extruded material consequently obtained was tested for tensile strength. The results are shown in Table 3.

TABLE 3

| No | Mg (%) | Pretreatment | Tensile strength in L direction (kg/mm$^2$) | Tensile strength in T direction (kg/mm$^2$) | T direction /L direction | Impact strength (kg.m/cm$^2$) | Apparatus | Presence/absence *3 of blister |
|---|---|---|---|---|---|---|---|---|
| Example | | | | | | | | |
| 9 | 0.6 | treatment with vibration *1 | 52 | 50 | 0.96 | 0.8 | FIG. 1 | nothing |
| 10 | 0.7 | treatment with agitation *2 | 49 | 47 | 0.96 | 0.8 | FIG. 3 | nothing |
| Comparative Experiment | | | | | | | | |
| 5 | 0 | treatment with vibration *1 | 50 | 43 | 0.86 | 0.5 | FIG. 1 | little amount |
| 6 | 0 | — | 50 | 35 | 0.70 | 0.4 | — | large amount |
| 7 | 0.7 | — | 49 | 32 | 0.65 | 0.4 | — | large amount |

*1 Vacuum degree $10^{-2}$ torr, frequency 100 Hz, acceleration 3 G, time of treatment 1 hour.
*2 Atmosphere $N_2$, revolution number 70 rpm.
*3 500° C. × 1 hour The samples of Comparative Experiments 6 and 7 showed large differences between tensile strength in the direction of extrusion (L direction) and that in the direction perpendicular to the direction of extrusion (T direction) and low magnitudes of impact strength. The sample of Comparative Experiment 5, because of the treatment with vibration as mechanical energy prior to the hot working, showed improved mechanical properties as compared with the samples of Comparative Experiments 6 and 7, though the improvements were not fully satisfactory. In contrast, the samples of Examples 9 and 10 showed no large difference between the tensile strengths in L and T directions and enjoyed high impact strength. They showed virtually no sign of blister.

What is claimed is:

1. A method for production of powder metallurgy alloy, comprising imparting mechanical energy by at least one of physical actions of vibration, pulverization, attrition, rolling, shocks, agitation and mixing without using grinding medium to metallic particles in a vessel whose interior is held under a vacuumized atmosphere or an atmosphere of inert gas so that said metallic particles contact with each other to improve surface quality thereof without causing plastic deformation of the metallic particles, and hot working said metallic particles thereby producing a working material.

2. A method according to claim (1), wherein said impartation of mechanical energy to said metallic particles is performed with said metallic particles heated to a temperature not exceeding the melting point thereof.

3. A method according to claim (1), wherein said metallic particles are heated to a temperature in the range of 100 to 300° C. before said impartation thereto of mechanical energy.

4. A method according to claim (1), wherein said metallic particles after impartation thereto of mechanical energy are subjected to a treatment for hot vacuum degassing and then to hot working.

5. A method according to claim (1), wherein said metallic particles have been produced by rapid solidification.

6. A method according to claim (5), wherein the cooling rate during said solidification of metallic particles is in the range of 50 to $10^{6}$° C./sec.

7. A method according to claim (1), wherein said metallic particles are aluminum alloy particles.

8. A method according to claim (7), wherein the metal components contained in said aluminum alloy have the following contents:

Si: 10 to 30% by weight
Mg: 0.1 to 20% by weight
Cu: 0.5 to 8.0% by weight
Fe: 0.5 to 10.0% by weight
Zn: 0.01 to 10.0% by weight 9. A method according to claim (1), wherein at least one of continuous fiber, short fiber, whisker and powder of refractory material of silicon carbide, silicon nitride, alumina, silica, alumina-silica, zirconia, beryllia, boron carbide or titanium carbide before said mechanical energy is imparted or before said metallic particles is hot worked.

10. A method according to claim (7), wherein said aluminum alloy particles have an oxide layer comprising Mg on their surface.

11. A method according to claim (1), wherein said metallic particles are vibrated in a vessel to become compact after they are imparted said mechanical energy and before they are hot worked.

12. A method for production of powder metallurgy alloy, comprising, preparing metal particles by rapid solidification in the range of 50 to $10^{6}$° C./sec., said metal particles having impurities on outer surfaces thereof, heating the metal particles to a temperature in the range of 100 to 300° C., providing the metal particles in a vessel with vacuumized atmosphere or an inert gas atmosphere, heating the metal particles inside the vessel at a atmosphere or an inert gas atmosphere, heating the metal particles inside the vessel at a temperature not exceeding the melting point of the metal particles and imparting mechanical energy to the metal particles by one of vibration, pulverization, attrition, rolling, shocks, agitation and mixing without using grinding medium so that impurities on the outer surfaces of the metal particles are removed by contact of the metal particles with each other, and subjecting hot working of the metal particles before characteristics of the metal particles do not change so that the metal particles strongly adhere with each other without making blisters therein.

13. A method for production of powder metallurgy alloy, comprising, preparing aluminum alloy particles by rapid solidification in the range of $10^{3}$ to $10^{6}$° C./sec. by nitrogen gas atomizing method, said aluminum alloy particles having diameter in the range of 44 to 149 micrometer and impurities on outer surfaces thereof, heating the aluminum alloy particles to a temperature in the range of 100 to 300° C., providing the aluminum alloy particles in a vessel with vacuumized atmosphere or an inert gas atmosphere, heating the aluminum alloy particles inside the vessel at a temperature not exceeding the melting point of the aluminum alloy particles and imparting mechanical energy to the aluminum alloy particles by one of vibration, pulverization, attrition, rolling, shocks, agitation and mixing without using grinding medium to that impurities on the outer surfaces of the aluminum alloy particles are removed by contact of the aluminum alloy particles with each other, and subjecting hot working of the aluminum alloy particles before characteristics of the aluminum alloy particles do not change so that the aluminum alloy particles strongly adhere with each other without making blisters therein.

* * * * *